US011589431B2

(12) United States Patent
Ha et al.

(10) Patent No.: US 11,589,431 B2
(45) Date of Patent: Feb. 21, 2023

(54) COOKING APPLIANCE

(71) Applicant: LG Electronics Inc., Seoul (KR)

(72) Inventors: Junghyeong Ha, Seoul (KR); Youngmin Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 650 days.

(21) Appl. No.: 16/604,712

(22) PCT Filed: Apr. 3, 2018

(86) PCT No.: PCT/KR2018/003903
§ 371 (c)(1),
(2) Date: Oct. 11, 2019

(87) PCT Pub. No.: WO2018/190553
PCT Pub. Date: Oct. 18, 2018

(65) Prior Publication Data

US 2020/0163176 A1 May 21, 2020

(30) Foreign Application Priority Data

Apr. 12, 2017 (KR) ..... 10-2017-0047292

(51) Int. Cl.
*H05B 6/76* (2006.01)
*H05B 6/64* (2006.01)

(52) U.S. Cl.
CPC ..... *H05B 6/763* (2013.01); *H05B 6/6414* (2013.01)

(58) Field of Classification Search
CPC ..... H05B 6/6414; H05B 6/763; H05B 6/70; H05B 6/64
USPC ..... 219/741, 742, 743, 744, 737, 738, 683, 219/763, 739, 756, 740
See application file for complete search history.

(56) References Cited

U.S. PATENT DOCUMENTS 3,629,537 A 12/1971 Haagensen
3,846,608 A 11/1974 Valles
4,475,023 A * 10/1984 Iwabuchi ..... H05B 6/763 219/742
4,532,069 A * 7/1985 Scherowsky ..... C09B 1/06 552/244

(Continued)

FOREIGN PATENT DOCUMENTS

DE 8606301 U1 5/1999
EP 1763286 A2 3/2007

(Continued)

OTHER PUBLICATIONS

Translation of DE 8606301, Microwave oven, May 23, 1990, by ProQuest (Year: 1990).*

(Continued)

*Primary Examiner* — Quang T Van
(74) *Attorney, Agent, or Firm* — Fish & Richardson P.C.

(57) ABSTRACT

A cooking appliance includes a frame defining a cooking chamber, a a magnetron for generating microwaves to cook food received in the cooking chamber, a door connected to the frame and configured to open and close the cooking chamber, a gasket disposed at the door and configured to contact a front portion of the frame based on the door closing the cooking chamber, and a leakage prevention part that is disposed at the door and that defines a space portion for preventing leakage of the microwaves. The gasket is coupled to the space portion.

20 Claims, 5 Drawing Sheets

(56) References Cited

U.S. PATENT DOCUMENTS

| | | | | |
|---|---|---|---|---|
| 4,584,447 | A | 4/1986 | Kusunoki et al. | |
| 8,288,695 | B2 * | 10/2012 | Nishijima ..... | H05B 6/6414 219/738 |

FOREIGN PATENT DOCUMENTS

| | | |
|---|---|---|
| JP | H06137563 | 5/1994 |
| KR | 2019990001969 | 1/1999 |
| KR | 100662415 | 12/2006 |
| KR | 1020060129126 | 12/2006 |
| KR | 1020120071985 | 7/2012 |

OTHER PUBLICATIONS

Extended European Search Report in European Appln. No. 18784163.0, dated Feb. 5, 2020, 8 pages.

PCT International Search Report in International Application No. PCT/KR2018/003903, dated Jul. 16, 2018, 4 pages (with English translation).

* cited by examiner

COOKING APPLIANCE

CROSS-REFERENCE TO RELATED APPLICATIONS

This application is a National Stage application under 35 U.S.C. § 371 of International Application No. PCT/KR2018/003903, filed on Apr. 3, 2018, which claims the benefit of Korean Patent Application No. 10-2017-0047292, filed on Apr. 12, 2017. The disclosures of the prior applications are incorporated by reference in their entirety.

TECHNICAL FIELD

The present invention relates to a cooling appliance.

BACKGROUND ART

In general, cooking appliances are home appliances that cook foods.

Such a cooking appliance may include a magnetron that cooks food by using microwaves according to kinds of cooking appliances.

When the cooking appliance includes the magnetron, a door of the cooking appliance includes a choke that prevents leakage of the microwaves.

A choke cover for blocking electromagnetic waves is disclosed in Korean Patent Publication No. 10-2003-0012639 that is a prior art document.

In the case of the prior art document, the choke is integrated with a choke part of a door frame. Here, a choke cover that is a dielectric is coupled to an inner peripheral portion of the choke, and a door panel and a screen are coupled to the outside of the choke.

The choke may be generally formed by bending a metal plate.

However, when the choke having the bent shape is formed on the door, the door is complicated in structure, and also, the choke cover made of a plastic material is separately provided to increase in number of components.

Also, in some cases, if it intends to additionally install a steam generator that cooks food by using steam in the cooking appliance according to the prior art document, there is a problem that the choke cover is deformed or melted by the high-temperature steam generated in the steam generator, and the choke is also deformed by the high-temperature steam and thus is deteriorated in function of blocking the electromagnetic waves.

DISCLOSURE OF THE INVENTION

Technical Problem

The present invention provides a cooking appliance that is capable of preventing microwaves from leaking while having a simplified structure.

The present invention also provides a cooking appliance that is capable of preventing steam as well as microwaves from leaking.

Technical Solution

A cooking appliance according to one aspect includes: a frame configured to define a cooking chamber; a magnetron configured to generate microwaves so as to cook food accommodated in a cooking chamber; a door connected to the frame to open and close the cooking chamber; a gasket disposed in the door to contact a front portion of the frame in a state in which the cooking chamber is closed by the door; and a leakage prevention part disposed in the door to define a space portion configured to prevent the microwaves from leaking, wherein the gasket is coupled to the space portion.

The door may include a front panel and a rear panel connected to the front panel, the rear panel may include an installation surface which faces the front portion and on which the gasket is installed, and the leakage prevention part may be disposed on the installation surface.

The rear panel may further include an insertion part inserted into the storage chamber when the storage chamber is closed by the door, and the installation surface may extend along an outer circumference of the insertion part.

The insertion part may be provided with an inner glass so that the inside of the storage chamber is visible from the outside.

The space portion may be a groove defined by recessing a portion of the installation surface in a direction away from the front portion or a groove defined by bending the installation surface several times.

A depth of the space portion of the leakage prevention part may be set to ¼ of a wavelength of the microwave.

The space portion may be disposed between a rear surface of the front panel and the front portion.

The leakage prevention part may include: a first space portion to which the gasket is coupled; a second space portion extending from the first space portion in a first direction; and a third space portion extending from the second space portion in a second direction that is opposite to the first direction.

The first space portion may extend in a horizontal direction, the second space portion may extend from the first space portion in an outer direction of the door, and the third space portion may extend from the first space portion in an inner direction of the door.

At least a portion of the second space portion may be disposed so as not to overlap the third space portion in the extension direction of the third space portion.

A plurality of second space portions may be arranged to be spaced apart from each other in the extension direction of the first space portion, and a plurality of third space portions may be arranged to be spaced apart from each other in the extension direction of the first space portion.

A depth of the first space portion may be set within a range of ⅙ to ⅛ of a wavelength of the microwave.

The leakage prevention part may include: a first space portion to which the gasket is coupled; and a second space portion extending from the first space portion in a direction away from the front portion, wherein the second space portion may have a depth and width, which are greater than those of the second space portion.

The cooking appliance may further include a steam generator configured to generate steam that heats the food within the cooking chamber.

Advantageous Effects

According to the proposed invention, there is an advantage that the leakage prevention part additionally performs the function of the installation groove of the gasket while the door is simplified in structure.

In addition, since the gasket covers the leakage prevention part, the separate cover member that covers the leakage prevention part may be unnecessary.

In addition, since the gasket installed on the door is disposed between the door and the front portion of the frame, the steam supplied into the storage chamber may be prevented from leaking.

MODE FOR CARRYING OUT THE INVENTION

Figure 1:
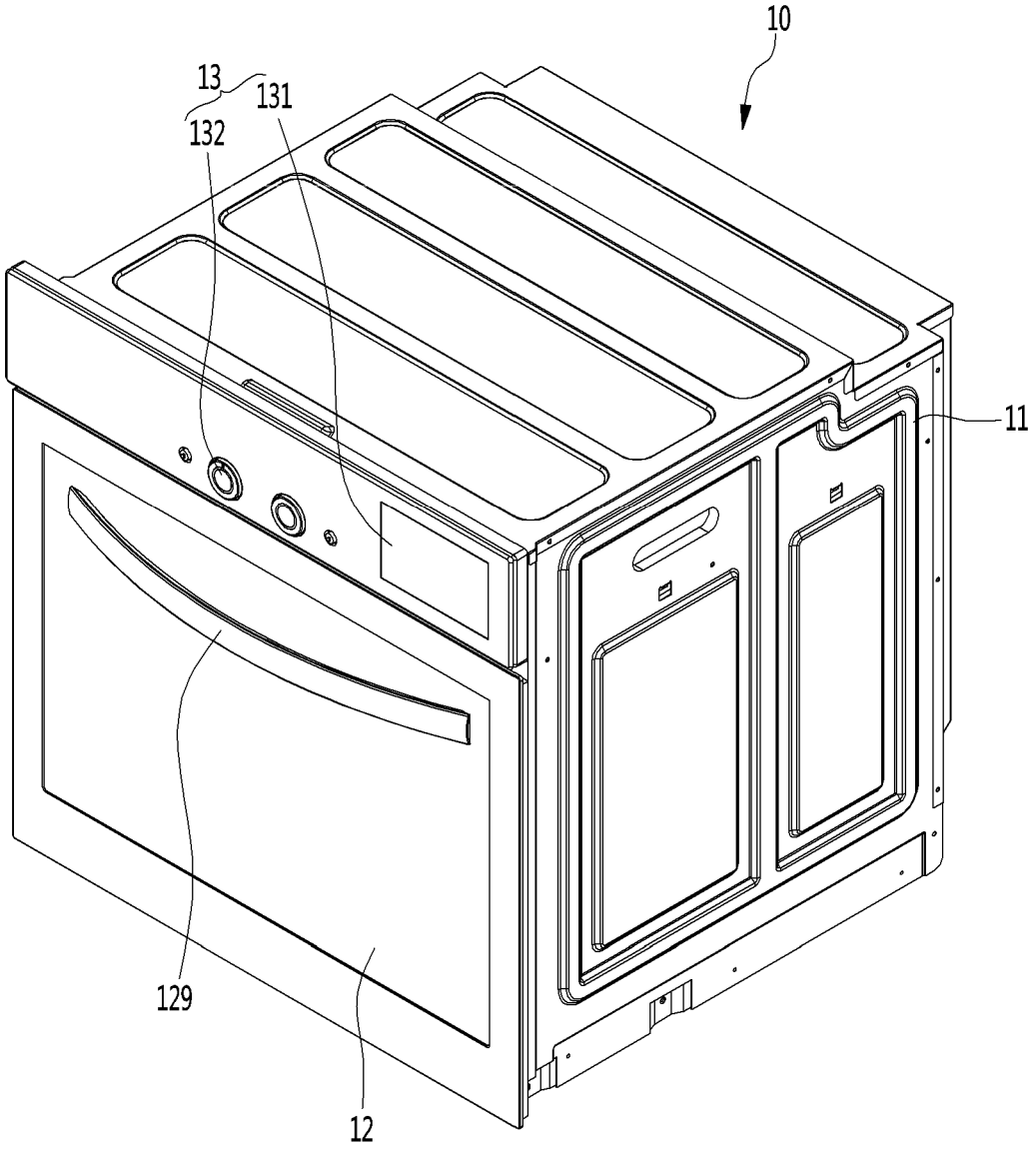
FIG. 1 is a perspective view of a cooking appliance according to an embodiment of the present invention.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected % coupled" or "joined" to the latter with a third component interposed therebetween.

Figure 2:
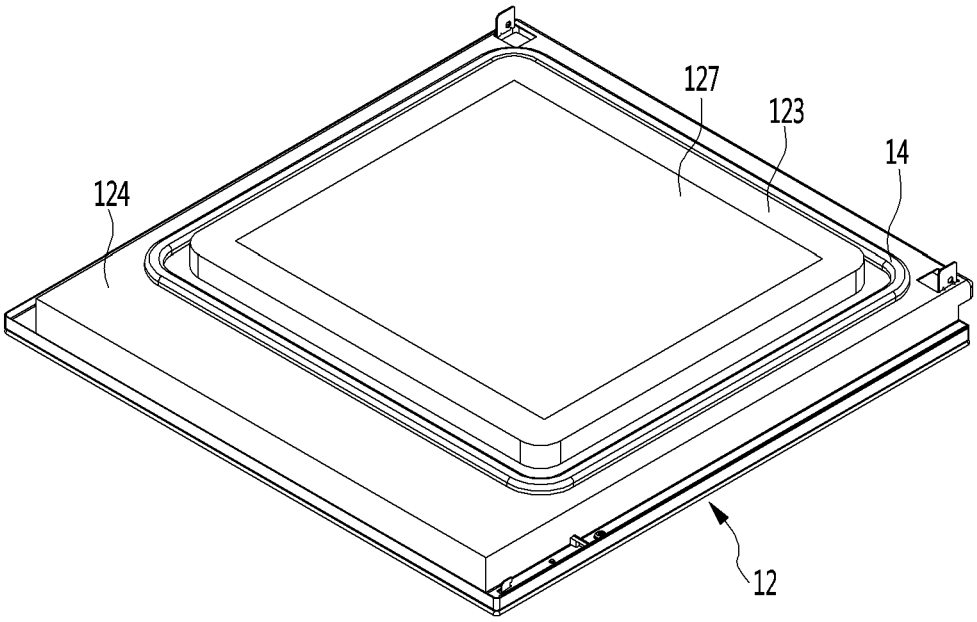
FIG. 2 is a perspective view of the cooking appliance in a state in which a door is opened in FIG. 1.
Figure 3:
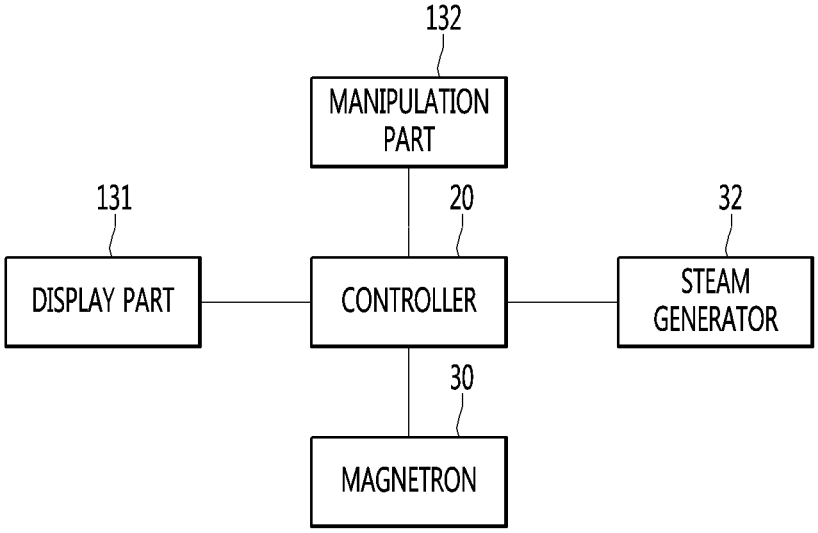
FIG. 3 is a block diagram of the cooking appliance according to an embodiment of the present invention.

FIG. 1 is a perspective view of a cooking appliance according to an embodiment of the present invention, FIG. 2 is a perspective view of the cooking appliance in a state in which a door is opened in FIG. 1, and FIG. 3 is a block diagram of the cooking appliance according to an embodiment of the present invention.

FIGS. 1 and 2 illustrate a state in which an outer case defining an outer appearance of the cooking appliance is removed as an example.

Figure 4:
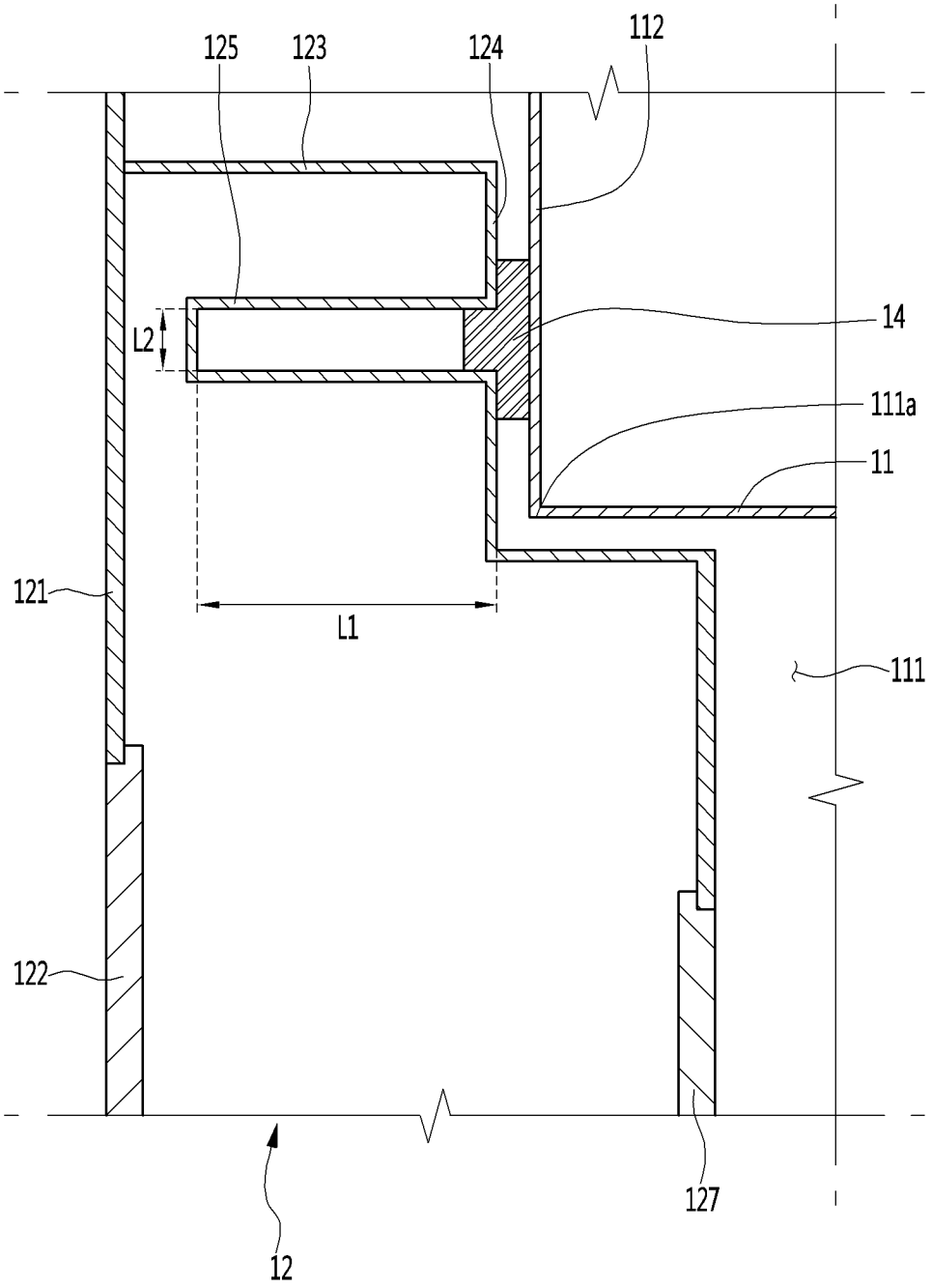
FIG. 4 is a vertical cross-sectional view of the door according to an embodiment of the present invention.

Referring to FIGS. 1 to 3, the cooking appliance 10 according to an embodiment of the present invention may include a frame 11 defining a cooking chamber (see reference numeral 111 of FIG. 4) and a door 12 connected to the frame 11 to open and close the cooking chamber (see reference numeral 111 of FIG. 4).

The door 12 may include a handle 129 to be held by a user. For example, the door 12 may open and close the cooking chamber (see reference numeral 111 of FIG. 4) in a rotation manner.

The cooking appliance 10 may further include a magnetron 30 generating microwaves for cooking food, a steam generator 32 generating steam, and a controller 20 controlling the magnetron 30 and the steam generator 32.

Also, the cooking appliance 10 may further include a control panel 13. The control panel may include a display part 131 displaying various pieces of information and a manipulation part 132 for inputting the various pieces of information.

The food may be cooked by any one of the magnetron 30 and the steam generator 32 according to an input manner for the cooking through the manipulation part 132 or kinds of food.

The magnetron 30 and the steam generator 32 may be installed on the frame 11. Also, a discharge hole of the steam generator 32 may communicate with the cooking chamber (see reference numeral 111 of FIG. 4) within the frame 11.

In the present invention, the magnetron 30 generates microwaves, and the microwaves have to be prevented from leaking from the cooking chamber 111. Thus, in this embodiment, the door 12 may include a structure for preventing the microwaves from leaking.

Also, steam may be generated from the steam generator 32. Also, the steam generated from the steam generator 32 and supplied into the cooking chamber (see reference numeral 111 of FIG. 4) have to be prevented from leaking to the outside.

Thus, in this embodiment, the door 12 may include a structure for preventing the steam from leaking.

Hereinafter, the structure of the door, which prevents the microwaves and the steam from leaking, will be described.

FIG. 4 is a vertical cross-sectional view of the door according to an embodiment of the present invention.

Referring to FIG. 4, the door 20 may include a gasket 14 that prevents the steam from leaking in a state in which the storage chamber 111 is closed.

The frame 11 may include a front portion extending vertically from a circumference of an inlet 111*a* of the storage chamber 111. In the state in which the door 20 closes the storage chamber 111, the gasket 14 may contact the front portion 111*a*.

Thus, in the state in which the door 20 closes the storage chamber 111, since the gasket 14 is disposed along the circumference of the storage chamber 111, the leakage of the steam may be prevented by the gasket 14.

Although not shown, a magnet may be provided on the gasket 14. Thus, the gasket 14 may be maintained in the state of contacting the front portion 111*a* by the magnet.

The door 20 may include a front panel 121 and a rear panel 123 coupled to the font panel 121.

For example, the front panel 121 may be made of a metal material. In this case, an opening may be defined in the front panel 121, and a transparent or translucent outer glass 122 may be coupled to the front panel 121 to cover the opening.

For another example, the front panel 121 may be made of a glass material. In this case, an opening may not be defined in the front panel 121.

The rear panel 123 may be coupled to a rear surface of the front panel 121. In the state in which the door 20 closes the storage chamber 111, a portion of the rear panel 123 may be inserted into the storage chamber 111. In this embodiment, the portion of the rear panel 123, which is disposed inside the storage chamber 111 may be called an insertion part.

When the portion of the rear panel 123 is inserted into the storage chamber 111, the rear panel 123 itself may serve to reduce a passage through which the steam flows.

An inner glass 127 disposed to face the outer glass 122 may be coupled to the rear panel 123. For example, the inner glass 127 may be disposed in the insertion part.

The user may confirm a cooked state of the food within the storage chamber 111 by the outer glass 122 and the inner glass 127 in the state in which the door 12 closes the storage chamber 111.

The rear panel 123 may include an installation surface 124 on which the gasket 14 is installed. The installation surface 124 may be a surface facing the front portion 112 of the frame 11.

The installation surface 124 may be disposed along an outer circumference of the insertion part.

The installation surface 124 may include a leakage prevention part 125 that prevents the microwaves from leaking. The leakage prevention part 125 may define a space portion for preventing the microwaves from leaking, and the gasket 14 may be coupled to the space portion.

For example, the leakage prevention part 125 may be a groove defined by recessing a portion of the installation surface 124 or a groove defined by bending the installation surface itself.

The space portion may be defined between the rear surface of the front panel 12 and the front portion 112.

For example, the leakage prevention part 125 may be disposed in the installation surface 124 so as to be recessed in a direction that is away from the front portion 112 or a direction of the front panel 121.

A portion of the gasket 14 may be fitted to be coupled to the leakage prevention part 125. In order to fit the gasket 14 into the leakage prevention part 125, a coupling part may be provided on the gasket 14.

The feature of the prevent invention may be implemented by the known structure in which the gasket 14 is coupled to the leakage prevention part 125, and the coupling part of the gasket 14 is fitted to be coupled, and thus, its detailed description will be omitted.

The structure for preventing the microwaves from leaking according to the present invention may be provided as an LC resonant circuit constituted by an inductor L and a capacitor C connected to the inductor L.

For example, an inductance may be generated by the leakage prevention part 125, and capacitance may be generated by a distance between the installation surface 124 and the front portion 112. Thus, a resonant frequency having a desired band may be generated.

Since the gasket 14 is coupled to the installation surface 124, when the gasket 14 contacts the front portion 112, the installation surface 124 may be spaced apart from the front portion 112 by the gasket 14.

Although not limited, a horizontal length L1 or a recessed depth of the leakage prevention part 125 may be ¼ (λ/4) of a wavelength of the microwave. Thus, the resonant frequency of the leakage prevention part 125 may be designed to have the same frequency as a central frequency of the microwave.

Alternatively, the horizontal length L1 or the recessed depth of the leakage prevention part 125 may be less than ¼ (λ/4) of the wavelength of the microwave.

Alternatively, although not limited, a vertical length L2 (or a width) of the leakage prevention part 125 may be set to 2 mm to 6 mm.

In the present invention, the leakage prevention part 125 may serve as an installation groove for the instillation of the gasket 14. It is necessary to provide the installation groove so as to install the gasket 14 on the rear panel 123. Thus, since the leakage prevention part 125 additionally performs the function of the installation groove, there is an advantage that the leakage of the microwaves is prevented while simplifying the structure of the rear panel 123.

In addition, since the gasket 14 covers the leakage prevention part, a separate cover member that covers the leakage prevention part may be unnecessary.

Figure 5:
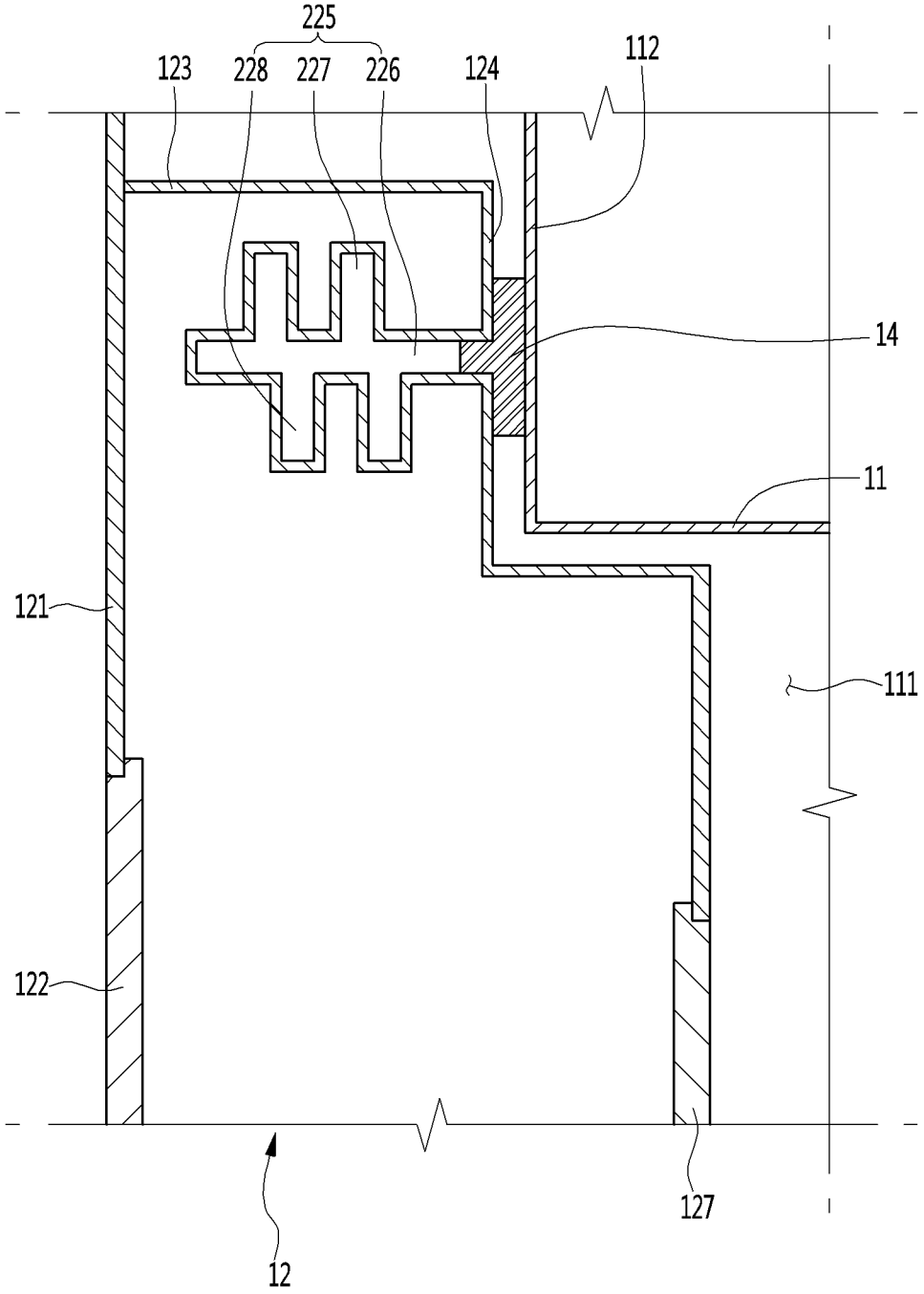
FIG. 5 is a vertical cross-sectional view of a door according to another embodiment of the present invention.

FIG. 5 is a vertical cross-sectional view of a door according to another embodiment of the present invention.

This embodiment is the same as the forgoing embodiment except for the leakage prevention part. Thus, only characterized parts in this embodiment will be described below.

Referring to FIG. 5, a leakage prevention part 225 according to this embodiment may include a first space portion 226, one or more second space portions 227 extending from the first space portion 226 in a first direction, and a third space portion extending from the first space portion 226 in a second direction that is opposite to the first direction.

For example, the first space portion 226 may be a groove defined in an installation surface 124 to extend in a direction away from a front portion 112. The second space portion 226 may extend horizontally from the door. Also, the gasket 14 may be connected to the first space portion 226.

For example, the second space portion 227 may extend from the first space portion 226 in an outer direction of the door 12. The third space portion 228 may extend from the first space portion 226 in an inner direction of the door 12.

For example, the second space portion 227 may be arranged to be spaced apart from the first space portion 226 in the extension direction of the first space portion 226. Also, the third space portion 228 may be arranged to be spaced apart from the first space portion 226 in the extension direction of the first space portion 226.

Here, a portion or the whole of the second space portion 227 may be disposed so as not to overlap the third space portion 228 in the extension direction of the third space portion 228.

Each of the second space portion 227 and the third space portion 228 may have a width (a horizontal length in the drawing) equal to or less than that (a vertical length in the drawing) of the first space portion 226.

In this embodiment, an inductance may be generated by the leakage prevention part 225, and capacitance may be generated by a distance between the installation surface 124 and the front portion 112. Thus, a resonant frequency having a desired band may be generated.

Like this embodiment, according to the configuration of the leakage prevention part 225, when a horizontal length (or a depth) of the first space portion 226 is less than ¼ (λ/4) of a wavelength of the microwave, the leakage of the microwaves may be prevented.

For example, the horizontal length (or the depth) of the first space portion 226 may be set within a range of ⅙ (λ/6) to ⅛ (λ/8) of the wavelength of the microwave.

Therefore, the length of the first space portion 226 may be reduced to reduce a size of the door 12 or apply the reduced length to the door having the small size.

Figure 6:
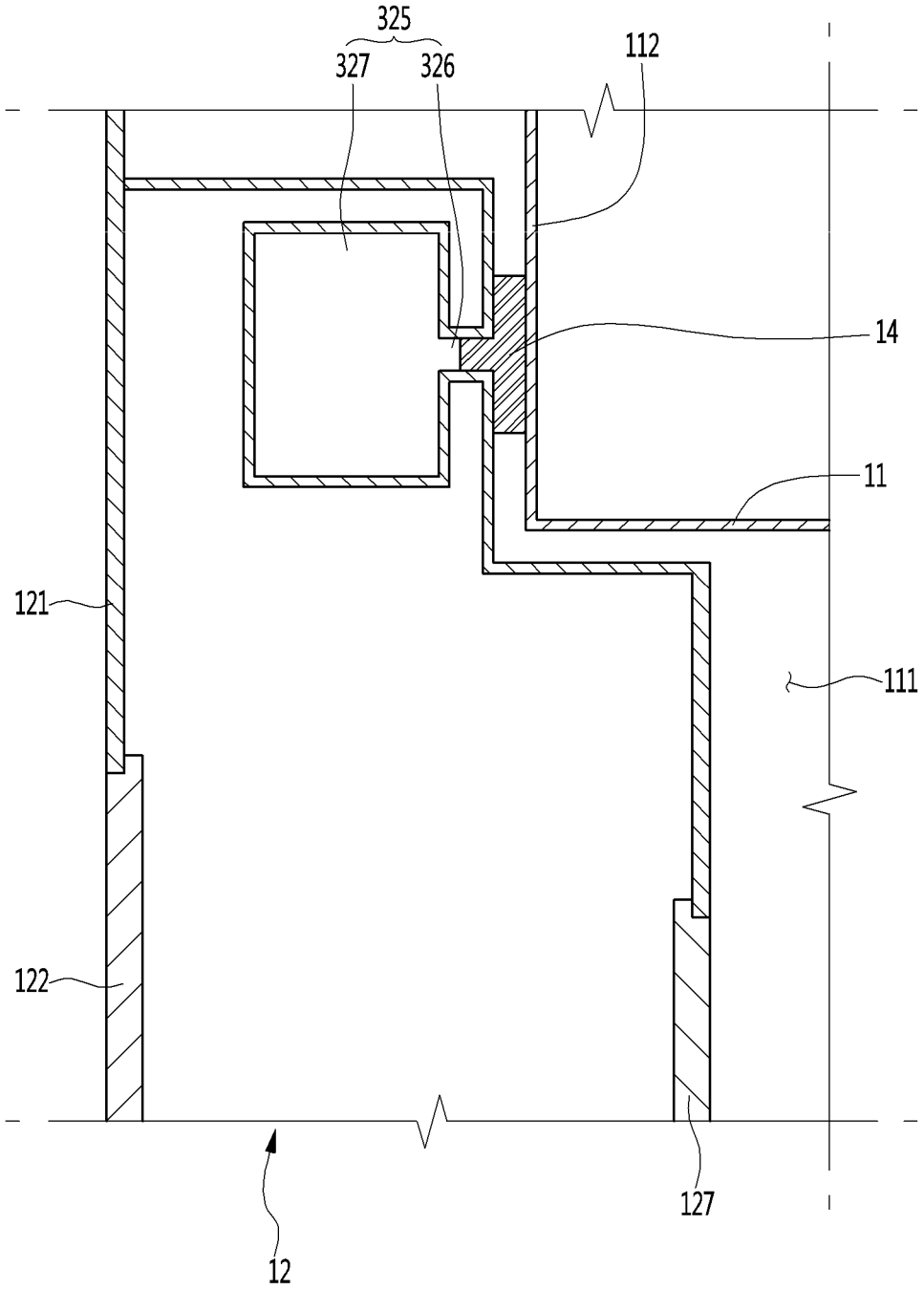
FIG. 6 is a vertical cross-sectional view of a door according to further another embodiment of the present invention.

FIG. 6 is a vertical cross-sectional view of a door according to further another embodiment of the present invention.

This embodiment is the same as the forgoing embodiment except for the leakage prevention part. Thus, only characterized parts in this embodiment will be described below.

Referring to FIG. 6, a leakage prevention part 325 according to this embodiment may include a first space portion 326 and a second space portion 327 extending from the first space portion 326 in a direction away from a front portion 112.

A horizontal length (depth) and a vertical length (width) of the second space portion 327 may be greater than those of the first space portion 326. Thus, the second space portion 327 has a volume greater than that of the first space portion 326.

Also, a gasket 14 may be connected to the first space portion 326.

According to this embodiment, the leakage prevention part 325 itself may generate inductance and capacitance to generate a resonant frequency having a desired band.

A distance between an installation surface 124 and a front portion 112 may vary according to a manufacturing error occurring in a manufacturing process of a door 12, an assembly error occurring in an assembly process of the door 12, and an assembly error occurring in a process of assembling the door 12 to a frame 11, and the like.

Thus, when the capacitance is generated by the distance between the installation surface 124 and the front portion 112, the resonant frequency set to prevent the microwave from leaking may be different from a central frequency of the microwave to cause the leakage of the microwaves.

However, in case of this embodiment, since the leakage prevention part 325 itself generates the inductance and the capacitance to generate the resonant frequency of the desired band, the leakage of the microwaves may be prevented regardless of the distance between the installation surface 124 and the front portion 112.

The invention claimed is:

1. A cooking appliance comprising:

a frame that defines a cooking chamber;

a magnetron configured to generate microwaves that cook food accommodated in the cooking chamber;

a door connected to the frame and configured to open and close the cooking chamber, the door comprising a front panel and a rear panel that is connected to the front panel;

a gasket disposed at the door and configured to contact a front portion of the frame based on the door closing the cooking chamber; and a leakage prevention part that is disposed at the door and that defines a space portion configured to prevent the microwaves from leaking, wherein the gasket is coupled to the space portion, wherein the rear panel of the door comprises:

an installation surface that faces the front portion of the frame and that supports the gasket, and an insertion part configured to insert into the cooking chamber based on the door closing the cooking chamber, wherein the space portion comprises a groove that is recessed from a portion of the installation surface in a direction away from the front portion of the frame, the groove having a recessed depth away from the front portion and a vertical length parallel to the front portion, and wherein the recessed depth of the groove is greater than the vertical length of the groove.

2. The cooking appliance according to claim 1, wherein the installation surface extends along an outer circumference of the insertion part.

3. The cooking appliance according to claim 2, wherein the door comprises an inner glass disposed at the insertion part and configured to allow an inside of the cooking chamber to be visible from an outside of the cooking chamber.

4. The cooking appliance according to claim 1, wherein the recessed depth of the groove is ¼ of a wavelength of the microwaves.

5. The cooking appliance according to claim 1, wherein the space portion is disposed between a rear surface of the front panel and the front portion.

6. The cooking appliance according to claim 1, wherein the groove of the space portion comprises:

a first space portion coupled to the gasket, the first space portion having a first depth recessed in the direction away from the front portion and a first vertical length parallel to the front portion; and a second space portion that extends from the first space portion in the direction away from the front portion, the second space portion having a second depth recessed in the direction away from the front portion and a second vertical length parallel to the front portion, and wherein the second has a depth is greater than the first depth, and the second vertical length is greater than the first vertical length.

7. The cooking appliance according to claim 1, further comprising a steam generator configured to generate steam that heats the food within the cooking chamber.

8. The cooking appliance according to claim 1, wherein at least a portion of the gasket is inserted to an inside of the groove and covers the groove.

9. The cooking appliance according to claim 1, wherein a vertical length of the gasket parallel to the front portion is greater than the vertical length of the groove.

10. A cooking appliance comprising:

a frame that defines a cooking chamber;

a magnetron configured to generate microwaves that cook food accommodated in the cooking chamber;

a door connected to the frame and configured to open and close the cooking chamber, the door comprising a front panel and a rear panel that is connected to the front panel;

a gasket disposed at the door and configured to contact a front portion of the frame based on the door closing the cooking chamber; and a leakage prevention part that is disposed at the door and that defines a space portion configured to prevent the microwaves from leaking, wherein the gasket is coupled to the space portion, wherein the space portion comprises:

a first space portion coupled to the gasket, a plurality of second space portions that extend from the first space portion in a first direction, and a plurality of third space portions that extend from the first space portion in a second direction that is opposite to the first direction.

11. The cooking appliance according to claim 10, wherein the first space portion extends in a horizontal direction, wherein the plurality of second space portions extend from the first space portion in an outer direction of the door, and wherein the plurality of third space portions extend from the first space portion in an inner direction of the door.

12. The cooking appliance according to claim 11, wherein at least a portion of the plurality of second space portions does not overlap with the plurality of third space portions in the second direction.

13. The cooking appliance according to claim 11, wherein the plurality of second space portions are spaced apart from each other in the horizontal direction, and wherein the plurality of third space portions are spaced apart from each other in the horizontal direction.

14. The cooking appliance according to claim 11, wherein a depth of the first space portion is set within a range of ⅙ to ⅛ of a wavelength of the microwaves.

15. The cooking appliance according to claim 10, wherein each of the plurality of second space portions comprises:

a first portion that overlaps with one of the plurality of third space portions along the first direction; and a second portion that does not overlap with the one of the plurality of third space portions along the first direction.

16. The cooking appliance according to claim 10, wherein the first space portion extends in a forward direction toward the front panel, the forward direction crossing the first direction and the second direction, and wherein the plurality of second space portions are offset from the plurality of third space portions in the forward direction.

17. The cooking appliance according to claim 16, wherein a recessed depth of the first space portion in the forward direction is greater than a vertical length of each of the plurality of second space portions in the first direction.

18. The cooking appliance according to claim 16, wherein a recessed depth of the first space portion in the forward direction is greater than a vertical length of each of the plurality of third space portions in the second direction.

19. The cooking appliance according to claim 16, wherein a recessed depth of the first space portion in the forward direction is greater than a horizontal length of each of the plurality of second space portions in the forward direction.

20. The cooking appliance according to claim 16, wherein a recessed depth of the first space portion in the forward direction is greater than a horizontal length of each of the plurality of third space portions in the forward direction.

* * * * *